US010266316B2

(12) United States Patent
Levy et al.

(10) Patent No.: US 10,266,316 B2
(45) Date of Patent: Apr. 23, 2019

(54) SELF-RESEALING VENTING ELASTOMERIC CLOSURE FOR USE WITH ORAL SYRINGES, PIPETTES AND THE LIKE

(71) Applicants: Abner Levy, Beverly Hills, CA (US); Natalie Levy Sarraf, Santa Monica, CA (US)

(72) Inventors: Abner Levy, Beverly Hills, CA (US); Natalie Levy Sarraf, Santa Monica, CA (US)

( * ) Notice: Subject to any disclaimer, the term of this patent is extended or adjusted under 35 U.S.C. 154(b) by 0 days.

(21) Appl. No.: 14/192,760

(22) Filed: Feb. 27, 2014

(65) Prior Publication Data

US 2015/0284154 A1 Oct. 8, 2015

Related U.S. Application Data

(60) Provisional application No. 61/771,075, filed on Feb. 28, 2013.

(51) Int. Cl.
*B65D 51/16* (2006.01)
*B65D 39/00* (2006.01)

(52) U.S. Cl.
CPC ..... *B65D 51/165* (2013.01); *B65D 39/0029* (2013.01)

(58) Field of Classification Search
CPC ..... B65D 51/002; B65D 39/0029
USPC ..... 215/325, 310, 364, 363, 355
See application file for complete search history.

(56) References Cited

U.S. PATENT DOCUMENTS 3,072,288 A * 1/1963 Lemmer ..... F16K 17/162 220/89.2
3,669,323 A * 6/1972 Harker ..... B65D 47/2031 222/490
2002/0131902 A1* 9/2002 Levy ..... B01L 3/50825 422/570
2004/0217081 A1* 11/2004 Konrad ..... B65D 51/002 215/247

* cited by examiner

*Primary Examiner* — Anthony Stashick
*Assistant Examiner* — Raven Collins
(74) *Attorney, Agent, or Firm* — Law Offices of Natan Epston

(57) ABSTRACT

A self-venting self-resealing pre-cut elastomeric closure for vials, bottles and the like, comprising a dished elastomeric septum supported for closing an opening in a container, a cut across the dished elastomeric septum, and additional cuts defining with the cross cut one or more flap areas elastically displaceable from a closed condition to a venting condition in response to insertion of a liquid transfer implement through the central area of the septum dish.

8 Claims, 1 Drawing Sheet

SELF-RESEALING VENTING ELASTOMERIC CLOSURE FOR USE WITH ORAL SYRINGES, PIPETTES AND THE LIKE

This Utility Patent Application claims priority to Provisional Patent Application No. 61/771,075 filed Feb. 28, 2013

BACKGROUND OF THE INVENTION

Field of the Invention

This invention relates to clinical, medical and laboratory equipment and supplies and more particularly relates to elastomeric closures for vials and other containers adapted to admit passage of liquid transfer implements such as pipettes and tips of oral syringes into the container for drawing doses of liquids held therein, in particular for dosing of pharmaceutical medications.

State of the Prior Art

Many elastomeric closures have been conceived for the aforedescribed purpose. Known elastomeric closures include those which are initially closed and are torn open by force of an implement tip as well as those which are pre-cut with slits of various configurations to facilitate passage and entry of the implement tip. A common difficulty with prior art elastomeric closures of this type has been that the closure encompasses and grips the liquid transfer implement to form an air tight seal which prevents interior air pressure from equilibrating with ambient air pressure. As liquid is drawn from the container a vacuum is created which limits the liquid flow into the transfer implement, and may pull fluid out of the implement as the implement is withdrawn from the container. In prior closures various measures have been taken to provide air passages and vents, through the elastomeric closure or otherwise, to facilitate equilibration of internal and ambient air pressures.

SUMMARY OF THE INVENTION

This invention provides a self-venting, self resealing pre-cut elastomeric closure for containers such as vials and the like from which doses of liquid are drawn with transfer implements such as blunt tipped pipettes and oral syringes.

Generally, the invention contemplates a dished elastomeric septum supported for closing an opening in a container. The dished elastomeric septum is pre-cut with a cross cut across the dished septum and additional cuts defining with the cross cut one or more flap areas elastically displaceable from a closed condition to a venting condition in response to insertion of a liquid transfer implement through the central area of the cross cut septum dish.

More specifically, the self-venting, self-resealing pre-cut elastomeric closure has a septum disc of elastomeric material supported for closing an opening into a container, a septum depression in the disc, the septum having a diameter smaller than the disc such that the depression is encompassed by an annular area of the disc. The septum is cut diametrically by a cross cut and a pair of mutually parallel chord cuts are made in the annular area. Each chord cut is connected to a corresponding end of the diametric cross cut thereby to define two wedge shaped flap areas each lying between the diametric cross cut and one of the chord cuts. The flap areas are elastically displaceable from a normally closed condition to an open venting condition in response to insertion of a liquid transfer implement such as a blunt tip of an oral syringe or a pipette through the diametric cross cut in the septum.

DETAILED DESCRIPTION OF THE INVENTION

This invention provides a self-venting, self resealing pre-cut elastomeric closure for ocontainers such as vials and the like from which doses of liquid are drawn with transfer implements such as blunt tipped pipettes and oral syringes.

Figure 1:
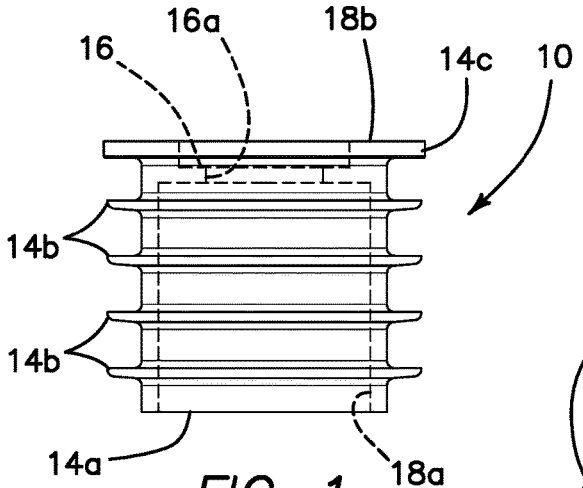
FIG. 1 is a side elevational view of a typical plug or stopper for closing a vial or bottle with the elastomeric septum in dotted lining supported therein.
Figure 2:
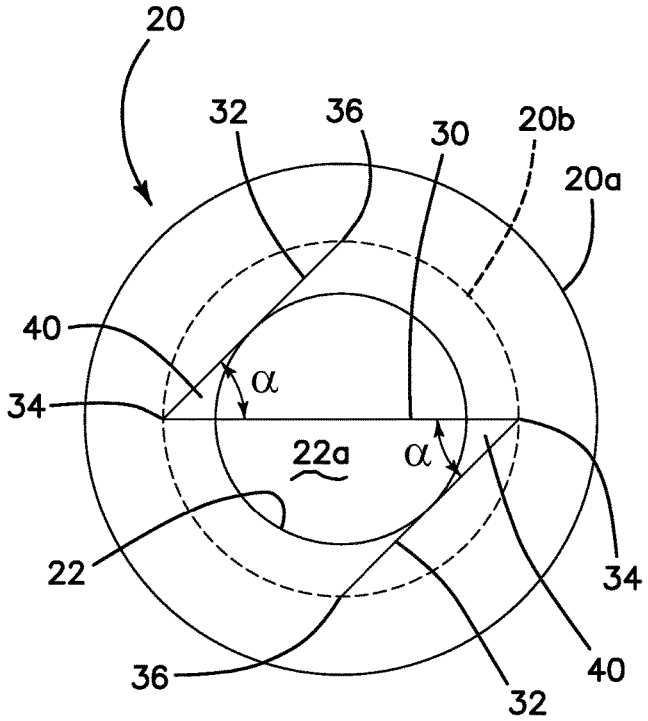
FIG. 2 is a top plan view of the plug of FIG. 1 showing the pre-cut elastomeric septum according to this invention.
Figure 3:
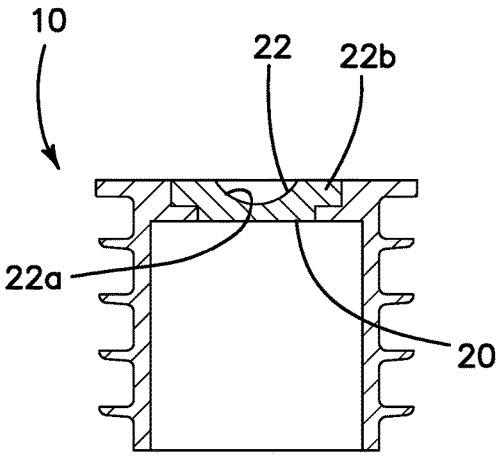
FIG. 3 is an elevational cross-section of the plug and elastomeric septum assembly as in FIG. 1.
Figure 3A:
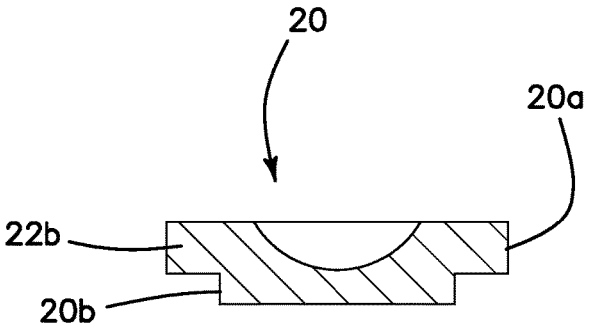
FIG. 3*a* is a diametric cross section of the elastomeric septum shown apart from the supporting plug.

In one form of the invention shown in FIGS. 1-3 of the accompanying drawings, the self-venting elastomeric closure has a cylindrical plug shell 10 adapted to fit tightly when pressed into the mouth or opening of a container and has a disc shaped elastomeric septum 20 supported in the center of the plug shell 10. FIG. 1 shows the empty shell 10 before installation by molding of the septum disc 20 shown separately in FIG. 3*a*. The outer rim of the septum disc 20 is supported on the circular ledge or lip 16 defining a central hole 16*a* in plug shell 10. A number of pliable radial ribs 14*b* extend from the shell 10 and serve to make retentive engagement with the inside diameter of the bottle mouth for holding the shell 10 in place and closing the bottle or other container.

The septum disc 20 includes a generally depressed dished portion 22 including a central area 22*a* of minimum thickness, the dished portion increasing in thickness radially from a minimum thickness to a thicker ring of elastomeric material encompassing the area of minimum thickness. The curvature of the depressed dished portion is preferably spherical and rises at the outer edge of the dish 22 to a maximum thickness. The depressed dish portion 22 and the area of minimum thickness 22*a* are shaped and configured to elastically distend for passing the blunt orificed end of an oral syringe neck through a self reclosing cut 30 across the septum disc. The septum is preferably made of a TPE (thermo plastic elastomer) material selected for good dimensional memory properties to provide good self-resealing of the cuts, and for moldability and chemical compatibility with the anticipated product to be held in the container. The dished portion 22 is encompassed by an annular rim area 22*b* of similar TPE material. The underside of the septum disc 20 is stepped inwardly to a reduced diameter of under-disc 20*b*, so that the ledge 16 is accommodated under the larger diameter upper disc portion 20*a* for supporting the septum disc 20 and the smaller diameter disc 20*b* fits into the central hole 16*a* of shell 10.

In a presently preferred embodiment of the invention the septum disc 20 is pre-cut with a diametric cross cut 30, the cross cut 30 having opposite ends, and by two mutually parallel chord cuts 32 outside but approximately tangential to the dished portion 22 of the septum 20. Preferably, the diametric cross cut extends across the dished septum depression and also across the encompassing annular area 22*b*. Each chord cut 32 has one end connected at 34 to one of the opposite ends of the diametric cross cut 30 at an acute interior angle (a) such that the cross cut and chord cuts together make up a letter Z or N pattern across the elastomeric septum. The opposite free end 36 of each chord cut 32 extends to an imaginary diameter line perpendicular to the diametric cross cut 30. The cuts 30 and 32 are vertical cuts through the full thickness of the septum disc 20. This Z shaped cut defines two wedge shaped flap areas 40 lying generally within the acute angles (a) defined between the opposite ends of the diametric cross cut 30 and the respective chord cuts 32.

When a pipette tip or oral syringe tip is inserted through the center of cross cut 30 in the area of minimum thickness 22*a* of the dished septum the lateral stresses caused by the presence of the tip through the cross cut and transmitted through the elastomeric material of the septum dish operate to flex the flap areas 40 away from their normal coplanar, horizontal, closed condition to an open venting condition. The flaps 40 tend to flex downwardly into the container and provide open air passages or vents allowing flow of air into and out of the container while the diametric cross cut 30 is distended and spread open by the tip of the liquid transfer implement passing through the septum 20. As a result liquid may be freely drawn from the container without impediment by vacuum forces into the transfer implement, whether by pulling on the plunger of an oral syringe or by squeezing on the bulb of a liquid transfer pipette. Once the desired dose has been drawn from the container and the transfer implement is withdrawn from the septum, the diametric cross cut 30 elastically returns to its normal closed condition and the flap areas 40 return to their normal coplanar closed condition. It has been found that the re-sealing of the septum disc 20 is effective against significant leakage of liquid from the container and the dosing operation can be repeated a sufficient number of times to deplete the contents of normally used containers without significant degradation of the elastomeric seal. This Z-cut septum is particularly effective when used for dosing of relatively viscous medications such as cough syrups and liquid Acetaminophen, because the medication bottle sealed with the closure of this invention may be inverted over the inserted oral syringe without leakage of the viscous liquid through the small apertures provided by the open flaps 40 during the dosing operation.

More generally, the invention contemplates a dished elastomeric septum pre cut with a cross cut and additional cuts defining with the cross cut one or more flap areas elastically displaceable from a closed condition to a venting condition in response to insertion of a liquid transfer implement through the central area of the cross cut septum dish.

The elastomeric septum disc 20 may be molded of a moldable TPE (thermo plastic elastomer) overmolded on a plug shell 10 formed of a polypropylene blend including Symprene™. Other materials may be found suitable and the invention is not limited to specific materials.

Specific dimensions for a presently preferred embodiment are shown and given in FIGS. 2 and 3 of the attached drawings. The diameter of the septum disc 20 is 0.445 in and the spacing between parallel chord lines 32 is 0.306 in. Each of the chord cuts is 0.197 in. long and the diametric cross cut is 0.315 in. long.

The septum disc 20 includes a larger diameter upper disc portion 20*a* and a smaller diameter under disc 20*b* molded together as one piece. The thickness of the top disc portion is 0.062 in. and the thickness of the under disc 20*b* is 0.039 in. The minimum thickness of the septum in area 22*a* is preferably 1.25 to 1.5 mm. The diameter of the depressed dish portion 22 is 0.215 in. and the radius of curvature of the spherical dish depression 22 is 0.133 in.

The currently preferred diameter of plug shell 10 includes 20, 24 and 28 mm plugs intended for use with standard bottles having corresponding mouth diameters. As indicated in FIG. 3 the height of the plug shell 10 measured from the bottom edge 14*a* to top surface 18*b* is 0.689 in.; the height to the underside of ledge 16 is 0.583, the height to the top of the same ledge 16 is 0.622 in., and the height to the underside of plug rim 14*c* is 0.646 in. Other dimensions of the plug and septum are given in FIGS. 2 and 3.

The elastomeric septum 20 as described herein can be supported by means other than the press-in plug 10; for example, the septum 20 can be supported in a screw-on type cap and particularly in child resistant type caps of the sort often provided with bottles containing pharmaceutical prescriptions dispensed for administration to children at home.

The self-venting self-resealing closure of this invention is not limited to use in medical and pharmaceutical applications, and may be found useful in other fields, such as the food industry and the cosmetics industry, for example.

While a preferred embodiment of the invention has been described and illustrated for purposes of clarity and invention, it will be understood that many changes, modifications and substitutions to the described embodiment will be apparent to those having ordinary skill in the art without departing from the scope of the following claims.

The invention claimed is:

1. A self-venting self-resealing pre-cut elastomeric closure for liquid containers such as vials, bottles and the like, comprising;

a septum disc of elastomeric material supported for closing an opening into a container, said disc having a top surface and an underside;

a dished septum depression in said top surface of said septum disc, said dished septum depression having a septum diameter smaller than said septum disc such that said depression is encompassed on said top surface by an annular rim area of said disc, said dished septum depression having a central area of minimum thickness, said minimum thickness being substantially smaller than said septum diameter and smaller than the thickness of said annular rim area;

a diametric cut across said dished septum depression, said diametric cut having opposite ends in said annular rim area outside said dished septum depression; and a pair of mutually parallel chord cuts in said annular rim area outside said depression, each of said chord cuts having a chord cut end connected to a corresponding one of said opposite ends of said diametric cut at an acute interior angle thereby to define two flap areas in said annular area each lying between said diametric cut and one of said chord cuts;

said flap areas being elastically downwardly displaceable away from a normally closed co-planar horizontal condition to a flexed open venting condition in response to insertion of a liquid transfer implement such as an oral syringe or a pipette through said diametric cut in across said dished septum.

2. The elastomeric closure of claim 1 wherein said diametric cut extends across said septum depression and at least part of said annular rim area.

3. The elastomeric closure of claim 1 wherein said chord cuts have free ends extending to the opposite ends of an imaginary diametric line perpendicular to said diametric cross cut.

4. The elastomeric closure of claim 1 wherein said chord cuts are nearly tangential to said septum depression.

5. A self-venting self-resealing pre-cut elastomeric closure for vials, bottles and the like, comprising:

a unitary septum disc of elastomeric material including a central dished septum encompassed by an annular rim area, said dished septum pre-cut with a cross cut across an area of minimum thickness of said dished septum, and two mutually parallel additional cuts through said disc in said annular rim area and outside said dished septum, said additional cuts defining with said cross cut a pair of flap areas in said annular rim area outside said dished septum;

said flap areas being elastically displaceable from a normally closed co-planar horizontal condition to a downwardly flexed open venting condition in response to insertion of a liquid transfer implement such as the tip of an oral syringe or a pipette through said diametric cut within said dished septum.

6. The elastomeric closure of claim 1 wherein said top surface is planar about said dished septum depression.

7. The elastomeric closure of claim 1 wherein said underside has a radial step between a thicker central disc and a thinner outer area.

8. The elastomeric closure of claim 7 wherein said diametric cut extends across said thicker central disc to said radial step and each of said chord lines extends between two circumferentially spaced points of said radial step.

* * * * *